US009879345B2

(12) United States Patent
Matsui et al.

(10) Patent No.: US 9,879,345 B2
(45) Date of Patent: Jan. 30, 2018

(54) CHEMICAL CONVERSION AGENT AND CHEMICAL CONVERSION COATING FILM

(71) Applicant: Nippon Paint Co., Ltd., Osaka (JP)

(72) Inventors: Norizumi Matsui, Tokyo (JP); Yuko Wada, Tokyo (JP); Akihiro Mizuno, Tokyo (JP); Junsuke Hokka, Tokyo (JP)

(73) Assignee: NIPPON PAINT SURF CHEMICALS CO., LTD., Tokyo (JP)

( * ) Notice: Subject to any disclaimer, the term of this patent is extended or adjusted under 35 U.S.C. 154(b) by 568 days.

(21) Appl. No.: 14/383,031

(22) PCT Filed: Mar. 8, 2013

(86) PCT No.: PCT/JP2013/056548
§ 371 (c)(1),
(2) Date: Sep. 4, 2014

(87) PCT Pub. No.: WO2013/133435
PCT Pub. Date: Sep. 12, 2013

(65) Prior Publication Data

US 2015/0027342 A1 Jan. 29, 2015

(30) Foreign Application Priority Data

Mar. 9, 2012 (JP) ..... 2012-053032

(51) Int. Cl.
*C23C 22/02* (2006.01)
*C23C 22/44* (2006.01)
*C23C 22/34* (2006.01)
*C23F 11/08* (2006.01)

(52) U.S. Cl.
CPC ..... *C23C 22/02* (2013.01); *C23C 22/44* (2013.01)

(58) Field of Classification Search
CPC ..... C23C 22/02; C23C 22/34; C23C 22/44; C23F 11/08
USPC ..... 106/1.22, 1.25, 14.14, 14.44; 146/247, 146/248, 274, 275
See application file for complete search history.

(56) References Cited

U.S. PATENT DOCUMENTS 4,992,115 A * 2/1991 Ikeda ..... C23C 22/44 148/247
6,361,833 B1 * 3/2002 Nakada ..... C23C 22/34 148/420
6,736,908 B2 * 5/2004 Sako ..... C23C 22/44 106/14.44
6,869,677 B1 3/2005 Uehara et al.
7,029,522 B2 * 4/2006 Matsui ..... C23C 22/34 106/14.44
2003/0168127 A1 9/2003 Hamamura et al.
2003/0209293 A1 11/2003 Sako et al.
2006/0027629 A1 * 2/2006 Inbe ..... C23C 22/34 228/101
2007/0068602 A1 * 3/2007 Pemberton ..... C23C 22/44 148/247
2008/0230394 A1 9/2008 Inbe et al.
2010/0170594 A1 7/2010 Inbe et al.
2013/0034743 A1 * 2/2013 Bannai ..... C23C 22/44 428/624
2013/0284049 A1 10/2013 Miura et al.
2014/0223740 A1 * 8/2014 Matsui ..... C23C 22/44 29/890.054
2015/0013947 A1 * 1/2015 Matsui ..... C23C 22/44 165/133
2016/0040298 A1 * 2/2016 Mizuno ..... C23C 22/44 148/247
2016/0060765 A1 * 3/2016 Mizuno ..... C23C 22/40 165/133

FOREIGN PATENT DOCUMENTS

CN 1330729 A 1/2002
CN 1386901 A 12/2002
CN 1730725 A 2/2006
EP 1136591 A1 9/2001
JP H01-208477 A 8/1989
JP 2000-199077 7/2000
JP 2000-345362 A 12/2000
JP 2001-181860 7/2001
JP 2002-30460 1/2002

(Continued)

OTHER PUBLICATIONS

English translation of the Written Opinion of the International Search Authority dated May 28, 2013 for PCT/JP2013/056548; 6 pages.*
HIDA Chemical Structure; http://www.chemspider.com/Chemical-Structure.6885.html; no date available; 4 pages.*
Notification that the Japan Patent Office has received an Information Statement by a third party issued in Japanese Patent Application No. 2012-053032, dated Jun. 28, 2016.
Notification that the Japan Patent Office has received an Information Statement by a third party dated Aug. 18, 2015 in Japanese Patent Application No. 2012-053032.
First notification of Office Action in Chinese Patent Application No. 201380012357.5, dated Oct. 19, 2015.

(Continued)

*Primary Examiner* — Helene Klemanski
(74) *Attorney, Agent, or Firm* — Knobbe Martens Olson & Bear LLP

(57) ABSTRACT

A chemical conversion agent which is capable of providing, for example, an aluminum-based metal material with excellent corrosion resistance and moisture resistance, while also providing the aluminum-based metal material with excellent adhesion with a laminate film, excellent hydrofluoric acid resistance, and excellent alkali resistance. The chemical conversion agent has (1) a mass concentration of zirconium of 5-5,000 ppm by mass; (2) a mass concentration of titanium is 5-5,000 ppm by mass; (3) a mass concentration of vanadium is 10-1,000 ppm by mass; (4) a mass concentration of a metal stabilizer is 5-5,000 ppm by mass; and (5) the pH is 2-6.

4 Claims, No Drawings

(56) References Cited

FOREIGN PATENT DOCUMENTS

| | | | |
|---|---|---|---|
| JP | 2002-060699 | A | 2/2002 |
| JP | 2002-145549 | A | 5/2002 |
| JP | 2002-275650 | A | 9/2002 |
| JP | 2005-008975 | | 1/2005 |
| JP | 2005-036161 | A | 2/2005 |
| JP | 2007-023353 | A | 2/2007 |
| JP | 2008-088551 | A | 4/2008 |
| JP | 2008-88552 | | 4/2008 |
| JP | 2008-183523 | | 8/2008 |
| JP | 2009-84516 | | 4/2009 |
| JP | 2009-084702 | A | 4/2009 |
| JP | 2009-132952 | A | 6/2009 |
| JP | 2009-263732 | A | 11/2009 |
| JP | 2010-261058 | | 11/2010 |
| JP | 2011-042842 | A | 3/2011 |
| JP | 2011-195942 | A | 10/2011 |
| JP | 2011-214105 | | 10/2011 |
| JP | 2011-214106 | A | 10/2011 |
| JP | 2012-17524 | | 1/2012 |
| KR | 10-2001-0099697 | A | 11/2001 |
| WO | WO 00/22188 | A1 | 4/2000 |
| WO | WO 2000/24948 | A1 | 5/2000 |
| WO | WO 2001/48264 | A1 | 7/2001 |
| WO | WO 2011/155538 | A1 * | 12/2011 |
| WO | WO 2013/042725 | A1 | 3/2013 |

OTHER PUBLICATIONS

International Search Report for International Application No. PCT/JP2014/059899, dated Jul. 8, 2014.

Office Action for Chinese Patent Application No. 201480019184.4, dated Sep. 29, 2016.

Office Action for Korean Patent Application No. 10-2015-7031255, dated Sep. 13, 2016.

* cited by examiner

CHEMICAL CONVERSION AGENT AND CHEMICAL CONVERSION COATING FILM

This application is the U.S. National Phase under 35 U.S.C. §371 of International Application PCT/JP2013/056548, filed Mar. 8, 2013, designating the U.S., and published in Japanese as WO 2013/133435 on Sep. 12, 2013, which claims priority to Japanese Patent Application No. 2012-053032, filed Mar. 9, 2012, the entire contents of which are incorporated herein by reference.

TECHNICAL FIELD

The present invention relates to a chemical conversion agent, and a chemical conversion coating film. More particularly, the present invention relates to a chemical conversion agent and a chemical conversion coating film which are preferably used for a surface treatment of an aluminum-based metal material.

BACKGROUND ART

An aluminum-based metal material has hitherto been employed as die castings, heat exchangers, food containers, members for secondary battery, and the like. It has been known that the corrosion reaction of the aluminum-based metal material proceeds due to moisture and contaminants adhered to a surface thereof, leading to the generation of white rust. Therefore, a chemical conversion treatment is applied to the surface of the aluminum-based metal material for the purpose of providing with excellent white rust resistance (hereinafter referred to as "corrosion resistance").

There have been proposed various chemical conversion agents capable of providing with excellent white rust resistance. A chemical conversion agent containing titanium complex fluoride ions, pentavalent vanadium compound ions, and zirconium complex fluoride ions are disclosed, for example, as a chemical conversion agent capable of providing a surface of aluminum or an alloy material thereof with satisfactory corrosion resistance (see Patent Document 1).

There is also disclosed, as technology capable of providing an aluminum-based metal material with excellent corrosion resistance, technology relating to a surface treatment agent including a resin compound having a specific structure, a vanadium compound, and a specific metal compound as essential components (see Patent Document 2). It is considered that this technology enables not only reduction of a vanadium compound but also significant improvement in stability of the vanadium compound, thus making it possible to maintain excellent corrosion resistance imparting effect for a long time by including a water-soluble organic compound having at least one functional group such as a hydroxyl group, a carbonyl group, or a carboxyl group, for example, ascorbic acid. It is also considered that the technology enables formation of a uniform coating film, thus making it possible to improve the level of corrosion resistance.

However, an improvement in blackening resistance (hereinafter referred to as "moisture resistance") has recently been regarded as important, in addition to an improvement in corrosion resistance, in applications, for example, heat exchangers. Herein, an indicator of corrosion resistance is white rust, whereas, an indicator of moisture resistance is blackening. White rust is a local corrosion phenomenon generated by a corrosion factor such as oxygen, water, and chloride ions, whereas, blackening is a general corrosion phenomenon generated by the existence of oxygen, water, and heat.

Thus, there is disclosed technology in which a chemical conversion treatment is applied using a chemical conversion agent including zirconium and/or titanium, and vanadium in each predetermined amount for the purpose of providing a heat exchanger made of aluminum with excellent corrosion resistance and moisture resistance (see Patent Document 3).

Meanwhile, a surface of an aluminum-based metal material is provided with design, and is also subjected to a lamination process for the purpose of protecting the surface. A laminate film used in the lamination process is excellent in processability, corrosion resistance, and barrier property of contents, and the like. Unlike paint, the laminate film is preferred in view of production environment since volatilization of an organic solvent does not occur. Such lamination process is often applied to a surface of a coil- or sheet-shaped aluminum-based metal material which is used in food containers and members for secondary battery.

The laminate film used in the lamination process has a problem that the laminate film might be peeled from a surface of the aluminum-based metal material when an advanced processing process is applied or a heat treatment is applied, since the laminate film has excellent properties mentioned above but is not sufficient in adhesion with a surface of an aluminum-based metal material. Such peeling of the laminate film may be a major factor which impairs appearance of the aluminum-based metal material, leading to deterioration of corrosion resistance of the aluminum-based metal material.

Thus, there is disclosed technology in which a metal surface treatment agent including a basic zirconium compound and/or a cerium compound, a carboxyl group-containing resin, and an oxazoline group-containing acrylic resin, and including no fluorine is applied to a surface of an aluminum-based metal material prior to a lamination process to form a surface treated layer, thus improving adhesion between a surface of a metal material and a laminate film (see Patent Document 4).

There is also disclosed technology in which a chemical conversion coating film is formed on a surface of an aluminum-based metal material using a chemical conversion agent including at least one polyvalent metal selected from the group consisting of zirconium, titanium, and chromium prior to a lamination process, and then a surface treated layer is formed using a metal surface treatment agent including an oxazoline group-containing resin and a primary amino group-containing resin (see Patent Document 5). It is considered that this technology enables an improvement in adhesion between a surface of a metal material and a laminate film, and also an improvement in corrosion resistance.

[Patent Document 1] Japanese Unexamined Patent Application, Publication No. 2010-261058
[Patent Document 2] Japanese Unexamined Patent Application, Publication No. 2011-181860
[Patent Document 3] Japanese Unexamined Patent Application, Publication No. 2011-214105
[Patent Document 4] Japanese Unexamined Patent Application, Publication No. 2009-84516
[Patent Document 5] Japanese Unexamined Patent Application, Publication No. 2008-183523

DISCLOSURE OF THE INVENTION

Problems to be Solved by the Invention

However, a further improvement in corrosion resistance and moisture resistance has recently been required for an aluminum-based metal material. Therefore, the current state is that technologies of Patent Documents 1-3 are not yet satisfactory. Especially, technologies of Patent Documents 1 and 2 are not technologies capable of improving moisture resistance since any study on moisture resistance is not made. Technologies of Patent Documents 2 and 3 do not disclose three components of zirconium, titanium, and vanadium as essential components, and are significantly different from technology of the present invention which assumes that these three components are essential component.

There is also a need to further improve adhesion between a surface of an aluminum-based metal material and a laminate film. Therefore, the current state is that technologies of Patent Documents 4 and 5 are not yet satisfactory. Especially, when using the aluminum-based metal material as an aluminum member for secondary battery, excellent fluorinated acid resistance and excellent alkali resistance are also required.

The present invention has been made in view of the above circumstances, and an object thereof is to provide a chemical conversion agent and a chemical conversion coating film capable of providing, for example, an aluminum-based metal material with excellent corrosion resistance and moisture resistance, while also providing the aluminum-based metal material with excellent adhesion with a laminate film, excellent hydrofluoric acid resistance and excellent alkali resistance.

Means for Solving the Problems

In order to achieve the above object, the present invention provides a chemical conversion agent in which (1) a mass concentration of zirconium is 5-5,000 ppm by mass; (2) a mass concentration of titanium is 5-5,000 ppm by mass; (3) a mass concentration of vanadium is 10-1,000 ppm by mass; (4) a mass concentration of a metal stabilizer is 5-5,000 ppm by mass; and (5) a pH is 2-6.

The metal stabilizer is preferably at least one selected from the group consisting of an organic compound having reducibility and an iminodiacetic acid derivative.

The chemical conversion agent is preferably used for a surface treatment of an aluminum-based metal material.

There is also provided a chemical conversion coating film formed using the chemical conversion agent according to the present invention, in which an amount of zirconium is 3-300 $mg/m^2$; an amount of titanium is 3-300 $mg/m^2$; an amount of vanadium is 1-150 $mg/m^2$, and an amount of the metal stabilizer is 0.5-200 $mg/m^2$ expressed in terms of carbon.

Effects of the Invention

According to the present invention, it is possible to provide a chemical conversion agent and a chemical conversion coating film capable of providing, for example, an aluminum-based metal material with excellent corrosion resistance and moisture resistance, while also providing the aluminum-based metal material with excellent adhesion with a laminate film, excellent hydrofluoric acid resistance and excellent alkali resistance.

Accordingly, the aluminum-based metal material, to which the chemical conversion agent and the chemical conversion coating film according to the present invention are applied, can be preferably used as die castings, heat exchangers, food containers, members for secondary battery, and the like.

PREFERRED MODE FOR CARRYING OUT THE INVENTION

Embodiments of the present invention will be described in detail below.

The chemical conversion agent of the present embodiment is a chemical conversion agent in which (1) the mass concentration of zirconium is 5-5,000 ppm by mass; (2) the mass concentration of titanium is 5-5,000 ppm by mass; (3) the mass concentration of vanadium is 10-1,000 ppm by mass; (4) the mass concentration of a metal stabilizer is 5-5,000 ppm by mass; and (5) the pH is 2-6.

The chemical conversion agent of the present embodiment is preferably used for a surface treatment of an aluminum-based metal material, and a chemical conversion coating film is formed on a surface thereof.

The aluminum-based metal material is often employed in applications such as members for secondary battery and heat exchangers since the aluminum-based metal material is excellent in processability, and has satisfactory corrosion resistance as compared with other metal materials. There is no particular limitation on shape of the aluminum-based metal material, and the aluminum-based metal material is processed into desired shapes depending on applications.

As used herein, "aluminum-based metal material" means a metal material such as an aluminum alloy containing aluminum, in addition to aluminum.

In the chemical conversion agent of the present embodiment, all of zirconium, titanium, and vanadium exist as various ions such as complex ions. Therefore, as used herein, the content of each of zirconium, titanium, and vanadium means a value expressed in terms of a metal element of various ions.

The chemical conversion agent of the present embodiment contains zirconium ions, titanium ions, and vanadium ions, and is prepared by dissolving a zirconium-based compound, a titanium-based compound, and a vanadium-based compound in water. In other words, the chemical conversion agent of the present embodiment is a solution containing zirconium ions, titanium ions, and vanadium ions as active species.

Zirconium ions changes due to the chemical conversion reaction, whereby, zirconium precipitates composed mainly of zirconium oxide are precipitated on a surface of an aluminum-based metal material. Examples of the zirconium-based compound as a supply source of zirconium ions include zirconium compounds such as fluorozirconic acid and zirconium fluoride; and salts thereof of lithium, sodium, potassium, ammonium, and the like. It is also possible to use those prepared by dissolving a zirconium compound such as zirconium oxide with a fluoride such as hydrofluoric acid. These zirconium-based compounds include fluorine and therefore have the function of etching a surface of the aluminum-based metal material.

Titanium ions change due to the chemical conversion reaction, whereby, titanium precipitates composed mainly of titanium oxide are precipitated on a surface of an aluminum-based metal material. Since titanium ions have lower precipitation pH than that of zirconium ions, titanium precipitates per se are likely to precipitate, and also enables promotion of the precipitation of the above-mentioned zirconium precipitates and the below-mentioned vanadium precipitates, thus making it possible to increase the amount of a coating film of a chemical conversion coating film formed mainly of these precipitates.

Examples of the titanium-based compound as a supply source of titanium ions include titanium compounds such as fluorotitanic acid and titanium fluoride; and salts thereof of lithium, sodium, potassium, ammonium, and the like. It is also possible to use those prepared by dissolving a titanium compound such as titanium oxide with a fluoride such as hydrofluoric acid. Like the above zirconium-based compound, these titanium-based compounds include fluorine and therefore have the function of etching a surface of the aluminum-based metal material. The etching function is higher than that of the zirconium-based compound.

Vanadium ions have property that they precipitate at the pH lower than that of titanium ions, whereby, vanadium precipitates composed mainly of vanadium oxide are precipitated on a surface of an aluminum-based metal material. More specifically, vanadium ions are converted into vanadium oxide due to the reduction reaction, whereby, vanadium precipitates are precipitated on a surface of an aluminum-based metal material.

Unlike zirconium precipitates and titanium precipitates having property that they generally cover except for a portion of the surface of the aluminum-based metal material, vanadium precipitates have property that they are likely to be precipitated on a segregated substance of the surface of the aluminum-based metal material on which zirconium precipitates and titanium precipitates are less likely to be formed. Whereby, the chemical conversion agent of the present embodiment can form a chemical conversion coating film, which is dense and has high coatability, using mainly zirconium precipitates, titanium precipitates, and vanadium precipitates, as compared with a conventional chemical conversion agent containing no vanadium ions.

Like a conventional chromium coating film, vanadium precipitates exert self-repairing effect due to the coexistence of zirconium and titanium, and property that they are excellent in coating film forming property. A minute amount of vanadium ions are appropriately eluted from vanadium precipitates and eluted vanadium ions oxidize and passivate the surface of the aluminum-based metal material, leading to self-repairing, thus maintaining satisfactory corrosion resistance. Meanwhile, when vanadium ions do not exist together with zirconium ions and titanium ions, vanadium precipitates are less likely to be precipitated. Even if vanadium precipitates are precipitated, a large amount of vanadium ions are eluted from the precipitates, thus failing to obtain the above-mentioned self-repairing effect.

Since the chemical conversion agent of the present embodiment contain zirconium ions, titanium ions, and vanadium ions, a chemical conversion coating film including zirconium, titanium, and vanadium is formed. Use of the chemical conversion agent of the present embodiment containing all of zirconium ions, titanium ions and vanadium ions as active species allows to form a chemical conversion coating film, which is denser and has high coatability, even in the vicinity of a segregated substance of a surface of the aluminum-based metal material.

As the vanadium-based compound which is a supply source of vanadium ions, di- to pentavalent vanadium compounds can be used. Specific examples thereof include metavanadinic acid, ammonium metavanadate, sodium metavanadate, vanadium pentoxide, vanadium oxytrichloride, vanadyl sulfate, vanadyl nitrate, vanadyl phosphate, vanadium oxide, vanadium dioxide, vanadium oxyacetylacetonate, vanadium chloride, and the like. These vanadium-based compounds contain no fluorine and therefore have no function of etching a surface of an aluminum-based metal material.

In the present embodiment, a tetravalent or pentavalent vanadium compound is preferred and, specifically, vanadyl sulfate (tetravalent) and ammonium metavanadate (pentavalent) are preferably used.

As mentioned above, in the chemical conversion agent of the present embodiment, the content of zirconium is 5-5,000 ppm by mass; the content of titanium is 5-5,000 ppm by mass; and the content of vanadium is 10-1,000 ppm by mass. By satisfying these ranges of contents, the aluminum-based metal material is provided with excellent corrosion resistance and excellent moisture resistance.

From the viewpoint of being capable of further enhancing the above effect, the content of zirconium is preferably 5-3,000 ppm by mass, the content of titanium is preferably 5-500 ppm by mass, and the content of vanadium is preferably 10-500 ppm by mass.

The chemical conversion agent of the present embodiment includes a metal stabilizer capable of stabilizing various metal ions of zirconium ions, titanium ions, and vanadium ions. The metal stabilizer used in the present embodiment is chelate-bonded with zirconium ions, titanium ions, and vanadium ions in a chemical conversion agent to form a complex. Thus, various metal ions of zirconium ions, titanium ions, and vanadium ions are stabilized in a chemical conversion agent.

Meanwhile, as mentioned above, various metal ions of zirconium ions, titanium ions, and vanadium ions have their own peculiar precipitation pH(s). Therefore, in a conventional chemical conversion agent, various metal ions are precipitated in order of increasing the precipitation pH by an increase in pH in an interfacial surface along with the etching reaction of a surface of an aluminum-based metal material, thus forming a chemical conversion coating film.

In contrast, in the chemical conversion agent of the present embodiment, since various metal ions are in a stable state as a result of formation of a complex due to the action of a metal stabilizer, the precipitation pH increases. Therefore, various metal ions are simultaneously precipitated as complexes at the pH higher than each precipitation pH peculiar to various metal ions. Specifically, various metal ions are simultaneously precipitated as complexes at the pH higher than the precipitation pH of zirconium ions having the highest precipitation pH. Thus, since a chemical conversion coating film, which is more uniform than heretofore, is formed and precipitated as a complex, leading to an increase in particle diameter of precipitates, it is possible to obtain a higher coating ratio than heretofore. Further, it is possible to obtain more excellent corrosion resistance than heretofore, especially excellent moisture resistance.

Accordingly, since the chemical conversion agent of the present embodiment include all of zirconium, vanadium, and titanium, the above-mentioned effects due to a metal stabilizer are satisfactorily exerted.

In the chemical conversion agent of the present embodiment, various metal ions converted into complex ions by the action of a metal stabilizer exist, together with metal ions remaining as metal ions without being converted into complex ions.

Here, in a conventional chemical conversion agent, various metal ions are precipitated at the defect portion of a surface of an aluminum-based metal material and, subsequently, the same metal is precipitated at the portion of the precipitated metal. Therefore, a coating film is not uniformly formed and thus defects are generated in the coating film.

In contrast, in the chemical conversion agent of the present embodiment, first, various metal ions not converted into complex ions are precipitated in order of the peculiar precipitation pH along with an increase in pH in an interfacial surface, thus coating the defect portion of the surface of the aluminum-based metal material. Next, the complex formed by the action of the metal stabilizer is precipitated at higher pH, thus uniformly forming a chemical conversion coating film.

In this way, the chemical conversion agent of the present embodiment is significantly different from a conventional chemical conversion agent in that the coating film forming step of a chemical conversion coating film is performed in two steps.

The metal stabilizer used in the present embodiment is preferably at least one selected from the group consisting of an organic compound having reducibility and an iminodiacetic acid derivative.

The organic compound having reducibility is preferably, for example, at least one selected from the group consisting of ascorbic acid, oxalic acid, aluminum lake, anthocyanin, polyphenol, aspartic acid, sorbitol, citric acid, and sodium gluconate. These organic compounds having reducibility stabilize vanadium having a valence, which is especially likely to change, by reduction.

As an aluminum lake, for example, "Food Blue No. 1 Aluminum Lake", "Food Red No. 2 Aluminum Lake", "Food Yellow No. 4 Aluminum Lake", and the like, manufactured by San-Ei Gen F.F.I., Inc. can be used.

As anthocyanin, for example, "Aruberi L" (registered trademark), "Techno Color Red ADK", and "My Thread A" manufactured by Mitsubishi-Kagaku Foods Corporation.

As polyphenol, polyphenols such as pyrogallol, catechin, and tannin, for example, "Pancil FG-70" and "Pancil FG-60" manufactured by Rilis Scientific Industry Co., Ltd.; and "PL-6757" and "PL-4012" manufactured by Gunei Chemical Industry.

The iminodiacetic acid derivative is preferably iminodiacetic acid or an iminodisuccinic acid tetrasodium salt.

As the iminodisuccinic acid tetrasodium salt, for example, "BaypureCX-100" manufactured by LANXESS Corporation can be used.

Among those listed above, ascorbic acid and anthocyanin are preferably used from the viewpoint of corrosion resistance, moisture resistance, and safety.

In the present embodiment, two or more kinds of metal stabilizers can be used in combination. Specifically, two or more kinds of organic compounds having reducibility may be used in combination, and one kind of an organic compound having reducibility and one kind of an iminodiacetic acid derivative may be used in combination and two or more kinds of iminodiacetic acid derivatives may be used in combination.

In the present embodiment, the content of the metal stabilizer is 5-5,000 ppm by mass. When the content of the metal stabilizer is less than 5 ppm by mass, various metal ions are not satisfactorily converted into complex metal ions, thus failing to obtain a uniform coating film. When the content is more than 5,000 ppm by mass, various metal ions are stabilized and the defect portion of a surface of an aluminum-based metal material cannot be coated, thus failing to obtain corrosion resistance and moisture resistance. The content of the metal stabilizer is preferably 10-2,000 ppm by mass, and the content within the above range facilitates a further enhancement in effect due to the above-mentioned metal stabilizer.

As mentioned above, the pH of the chemical conversion agent of the present embodiment is 2-6, and preferably 3-5. When the pH is lower than 2, excessive etching due to the chemical conversion agent occurs, thus forming a non-uniform chemical conversion coating film. When the pH is higher than 6, it is impossible to form a chemical conversion coating film with a sufficient amount of a coating film because of insufficient etching. The pH of the chemical conversion agent can be adjusted using a common acid or alkali, such as sulfuric acid, nitric acid, or ammonia.

The chemical conversion agent of the present embodiment may contain metal ions of manganese, zinc, cerium, trivalent chromium, magnesium, strontium, calcium, tin, copper, iron, and silicon compounds; and phosphorus compounds such as phosphoric acid and condensed phosphoric acid for the purpose of improving rust-prevention property; and various rust-preventive agents, for example, various silane coupling agents such as aminosilane and epoxysilane for the purpose of improving adhesion.

The chemical conversion agent of the present embodiment may also contain 50-5,000 ppm by mass of aluminum ions and 1-100 ppm by mass of free fluorine ions.

When using an aluminum-based metal material to be subjected to a chemical conversion treatment, aluminum ions elute from the material to be subjected to a chemical conversion agent, and it is possible to promote a chemical conversion reaction by positively adding aluminum ions, additionally. It is also possible to form a chemical conversion coating film having more excellent corrosion resistance by setting the concentration of free fluorine ions to higher concentration than usual.

From the viewpoint of being capable of further enhancing the above effect, the content of aluminum ions is more preferably 100-3,000 ppm by mass, and still more preferably 200-2,000 ppm by mass. Similarly, the content of free fluorine ions is more preferably 5-80 ppm by mass, and still more preferably 15-50 ppm by mass.

Examples of a supply source of aluminum ions include aluminates such as aluminum nitrate, aluminum sulfate, aluminum fluoride, aluminum oxide, alum, aluminum silicate, and sodium aluminate; and fluoroaluminates such as sodium fluoroaluminate.

Examples of a supply source of free fluorine ions include hydrofluoric acid and salts thereof, such as hydrofluoric acid, ammonium hydrogen fluoride, zirconium hydrofluoric acid, and titaniumhydrofluoric acid; metal fluorides such as sodium fluoride, zirconium fluoride, and titanium fluoride; and ammonium fluoride. When using zirconium fluoride and titanium fluoride, it is possible to provide the same supply source as those of zirconium ions and titanium ions.

Use of the chemical conversion agent of the present embodiment with the above constitution enables formation of a chemical conversion coating film of the present invention. The method for a chemical conversion treatment using the chemical conversion agent of the present embodiment is not particularly limited and may be any method such as a spray method or a dipping method. The temperature of the chemical conversion agent is preferably 45-70° C., and more preferably 50-65° C. The time of the chemical conversion treatment is preferably 20-900 seconds, and more preferably 30-600 seconds. By satisfying these conditions, it is possible to form a chemical conversion coating film having excellent corrosion resistance and excellent moisture resistance.

In the method for a chemical conversion treatment using the chemical conversion agent of the present embodiment, after contacting the chemical conversion agent with a surface of a metal material, the metal material may be washed with water or may not be washed.

In the chemical conversion coating film obtained using the chemical conversion agent of the present embodiment, the amount of zirconium is preferably 3-300 mg/m$^2$, the amount of titanium is preferably 3-300 mg/m$^2$, the amount of vanadium is preferably 1-150 mg/m$^2$, and the amount of a metal stabilizer is preferably 0.5-200 mg/m$^2$ expressed in terms of carbon. By satisfying these ranges of amounts, more excellent corrosion resistance and more excellent moisture resistance are obtained. A ratio of the amount of zirconium to the amount of titanium varies depending on a surface state of the aluminum-based metal material to be subjected to a chemical conversion treatment, especially the amount of a segregated substance, and the total amount thereof may be within the above range.

The amount of zirconium, the amount of titanium, and the amount of vanadium in the chemical conversion coating film are determined by carrying out the measurement using an X-ray fluorescence spectrometer "XRF-1700" (manufactured by Shimadzu Corporation) so that the size of the aluminum-based metal material in the chemical conversion coating film becomes the size measuring 10 mm×10 mm or more, followed by calculation from the measurement results.

The amount of a metal stabilizer in the chemical conversion coating film is calculated from the measurement results of a TOC device "TOC-VCS" (manufactured by Shimadzu Corporation) as the amount of an organic carbon in the chemical conversion coating film (i.e., expressed in terms of carbon). When including various rust-preventive agents listed above so as to improve rust-prevention property, the amount of C derived from the metal stabilizer is calculated from the amount of C measured by the above TOC device by subtracting the amount of C calculated based on the measured values such as the amounts of Si, P, and N included in various rust-preventive agents.

The above-described chemical conversion agent and chemical conversion coating film of the present embodiment are preferably used for a surface treatment of a member for secondary battery made of an aluminum-based metal material. A battery packaging material and electrodes are included as the member for secondary battery. In this case, first, a chemical conversion coating film is formed on a surface of an aluminum-based metal material using the chemical conversion agent of the present embodiment, and then an adhesion treating agent is applied to form an adhesion treating layer. Then, laminate films are laminated to obtain an aluminum member for secondary battery.

The battery packaging material is preferably, for example, a lithium ion battery packaging material. Especially in a lithium ion battery packaging material for automobile, from the viewpoint of safety, high-level fluorinated acid resistance and high-level alkali resistance are required, in addition to high-level laminate adhesion (adhesion between a surface of a metal material and a laminate film). The reason is as follows.

In the lithium ion battery, those prepared by dissolving an electrolyte in aprotic solvents such as propylene carbonate and ethylene carbonate are usually used as an electrolytic solution. From the viewpoint of a stable operation of a battery, alkali lithium salts such as $LiPF_6$ and $LiBF_4$ are used as the electrolyte. Therefore, high alkali resistance is required for a lithium ion battery packaging material. These lithium salts are hydrolyzed to generate hydrofluoric acid having strong corrosiveness. Therefore, the lithium ion battery packaging material is required to have high fluorinated acid resistance.

In this regard, according to a battery packaging material obtained by forming a chemical conversion coating film by the chemical conversion agent of the present embodiment, followed by a lamination process via an adhesion treating layer, excellent adhesion with a laminate film, excellent fluorinated acid resistance, and excellent alkali resistance are obtained, in addition to the above-mentioned excellent corrosion resistance and excellent moisture resistance. These effects are more enhanced by controlling the contents of zirconium, titanium, vanadium, and a metal stabilizer within the above range, and controlling the pH within the above range. Accordingly, the chemical conversion agent of the present embodiment is preferably used for a surface treatment of a lithium ion battery packaging material.

A conventionally known adhesion treating agent is used as the adhesion treating agent. For example, those which include an oxazoline group-containing resin and a primary amino group-containing resin and, if necessary, at least one selected from the group consisting of a glycidyl group-containing resin, a phenolic hydroxyl group-containing resin, a carboxyl group-containing resin, and a block isocyanate group-containing resin can be used.

An oxazoline group-containing resin including an acrylic skeleton as a main chain is preferably used as the oxazoline group-containing resin from the viewpoint of excellent stability in a water solvent, and colorless and transparent appearance after coating. For example, "EPOCROS WS700" (trade name, manufactured by Nippon Shokubai Co., Ltd.) is used as the oxazoline group-containing resin including an acrylic skeleton as a main chain.

The content of the oxazoline group-containing resin in the adhesion treating agent is preferably 10% by mass-90% by mass based on the resin solid component. The content within the above range enables more excellent adhesion with a laminate film. More preferably, the content is 20% by mass-60% by mass.

For example, polyallylamine, polylysine, and polyvinylamine are used as the primary amino group-containing resin. Of these, polyallylamine is preferably used from the viewpoint of high reactivity with a polyvalent metal in a chemical conversion coating film, and excellent adhesion. For example, "PAA-15C" (manufactured by Nittobo Medical Co., Ltd.) is used as polyallylamine.

The content of the primary amino group-containing resin in the adhesion treating agent is preferably 10% by mass-90% by mass based on the resin solid component. The content within the above range enables more excellent adhesion with a laminate film. More preferably, the content is 20% by mass-60% by mass.

The glycidyl group-containing resin, the phenolic hydroxyl group-containing resin, the carboxyl group-containing resin, and the block isocyanate group-containing resin is crosslinked with an oxazoline group of the oxazoline group-containing resin and an amino group of the primary amino group-containing resin by heating when forming an adhesion treating layer. It is preferred since a stable three-dimensional network is formed.

The adhesion treating agent is applied on a surface of an aluminum-based metal material, on which a chemical conversion coating film is formed, by a conventionally known technique. Specifically, the adhesion treating agent is applied by a roll coating method, a bar coating method, a spray treatment method, a dip treatment method, and the like. After application, the adhesion treating agent is dried by heating at 40° C.-160° C. for 2 seconds-60 seconds to form an adhesion treating layer.

The amount of a dry coating film expressed in terms of whole organic carbon of the adhesion treating layer is preferably 5 mg/m$^2$-1,000 mg/m$^2$. The amount within the above range enables more excellent adhesion with a laminate film, and more excellent fluorinated acid resistance and more excellent alkali resistance.

A resin film is used as a laminate film. As the resin film, for example, thermoplastic resins such as polyethylene terephthalate (PET), polyethylene naphthalate (PEN), polypropylene (PP), polycarbonate (PC), triacetyl cellulose (TAC), polyvinyl chloride (PVC), polyester, polyolefine, polyphenylene sulfide (PPS), and acryl can be used.

Examples of the lamination processing method of laminating a laminate film include, but are not particularly limited to, a dry lamination method, an extrusion lamination method, and the like.

The present invention is not limited to the embodiments mentioned above, and modifications and improvements are included in the present invention as long as the object of the present invention can be achieved.

EXAMPLES

The present invention will be described in more detail by way of Examples, but the present invention is not limited thereto. Part(s), percentage(s), and ppm(s) are by mass unless otherwise specified.

Examples 1-31 and Comparative Examples 1-10

[Preparation of Chemical Conversion Agent]

In accordance with a conventionally known preparation method, the respective components were dispensed and mixed so that the content of each of zirconium, titanium, vanadium, and a metal stabilizer, and the pH become the values as shown in Table 1 and Table 2, and adding ion-exchanged water to prepare a chemical conversion agent. Fluorozirconic acid was used as a zirconium ion supply source, fluorotitanic acid was used as a titanium supply source, and vanadyl sulfate was used as a vanadium supply source.

[Preparation of Adhesion Treating Agent]

Using EPOCROS WS700 (manufactured by Nippon Shokubai Co., Ltd.) and PAA-15C (manufactured by Nittobo Medical Co., Ltd.), an adhesion treating agent was prepared so that a solid component ratio becomes 1:1 and a solid component concentration becomes 3%.

[Fabrication of Specimens]

A chemical conversion treatment was carried out by dipping aluminum material pieces (manufactured by Nippon Testpanel Co., Ltd., material: A1100P, size: 0.8×70×150 mm) in the thus obtained respective chemical conversion agents at 50° C. for 60 seconds to fabricate specimens of the respective Examples and Comparative Examples.

[Fabrication of Aluminum Member Specimens for Secondary Battery]

A chemical conversion treatment was carried out by dipping aluminum material pieces (manufactured by Nippon Testpanel Co., Ltd., material: A3003P, size: 0.8×70×150 mm) in the thus obtained respective chemical conversion agents at 50° C. for 60 seconds, and then the above-mentioned adhesion treating agent was applied. Then, aluminum member specimens for secondary battery of the respective Examples and Comparative Examples were fabricated by thermally bonding at 240° C. for 15 seconds under a pressure of 0.4 MPa in a state where a film (PP or PET) is interposed between two aluminum material pieces.

Evaluation

With regard to the specimens fabricated in the respective Examples and Comparative Examples, and aluminum member specimens for secondary battery, moisture resistance and corrosion resistance were evaluated. With regard to the aluminum member specimens for secondary battery fabricated in the respective Examples and Comparative Examples, laminate adhesion, fluorinated acid resistance, and alkali resistance were evaluated.

[Moisture Resistance]

With regard to the specimens fabricated in the respective Examples and Comparative Examples, and the aluminum member specimens for secondary battery, a humidity test was carried out under atmosphere at a temperature of 70° C. and a relative humidity of 98% or more for 500 hours. After the test, area where rust occurs was visually evaluated according to the following evaluation criteria. Moisture resistance was evaluated by two evaluators based on an average of the evaluation results of two evaluators. Since blackening has property that it finally changes into white rust, the area where rust occurs was calculated as the total of the area where blackening occurs and the area where white rust occurs. The results are shown in Table 1 and Table 2.

(Evaluation Criteria)

10: No rust occurs.
9: Area where rust occurs is less than 10%.
8: Area where rust occurs is 10% or more and less than 20.
7: Area where rust occurs is 20% or more and less than 30%.
6: Area where rust occurs is 30% or more and less than 40%.
5: Area where rust occurs is 40% or more and less than 50%.
4: Area where rust occurs is 50% or more and less than 60%.
3: Area where rust occurs is 60% or more and less than 70%.
2: Area where rust occurs is 70% or more and less than 80%.
1: Area where rust occurs is 80% or more and less than 90%.
0: Area where rust occurs is 90% or more.

[Corrosion Resistance]

With regard to the specimens fabricated in the respective Examples and Comparative Examples, and the aluminum member specimens for secondary battery, 5% by mass saline was sprayed at 35° C. in accordance with JIS Z 2371, the area where white rust occurs was visually evaluated according to the above evaluation criteria of moisture resistance after a lapse of 500 hours. Corrosion resistance was evaluated by two evaluators based on an average of the evaluation results of two evaluators. The results are shown in Table 1 and Table 2.

[Laminate Adhesion]

With regard to the aluminum member specimens for secondary battery fabricated in the respective Examples and Comparative Examples, peel strength was measured using a load cell "LTS-200N-S100" (manufactured by Minebea Co., Ltd.). A peeling rate at the measurement of the peel strength was set at 20 mm/min. Specimens where the tensile strength is 30 N/5 mm or more were rated "pass (P)", while specimens where the tensile strength is less than 30 N/5 mm were rated "fail (F)". The results are shown in Table 2.

[Hydrofluoric Acid Resistance]

The aluminum member specimens for secondary battery fabricated in the respective Examples and Comparative Examples were dipped in a 1,000 ppm hydrofluoric acid solution at 80° C. for 2 weeks. As a result, specimens where no peeling was confirmed were rated "pass (P)", while specimens where peeling was confirmed were rated "fail (F)". The results are shown in Table 2.

[Alkali Resistance]

The aluminum member specimens for secondary battery fabricated in the respective Examples and Comparative Examples were dipped in an aqueous 0.5% LiOH solution at 40° C. for 10 seconds. As a result, specimens where no whitening was confirmed were rated "pass (P)", while specimens where whitening was confirmed were rated "fail (F)". The results are shown in Table 2.

[Amount of Coating Film]

The amount of zirconium, the amount of titanium, and the amount of vanadium in a chemical conversion coating film formed on a surface of each of specimens fabricated in the respective Examples and Comparative Examples, and the and aluminum member specimens for secondary battery were calculated from the measurement results of an X-ray fluorescence spectrometer "XRF-1700" (manufactured by Shimadzu Corporation) so that each specimen has a size measuring 10 mm×10 mm or more.

The amount of a metal stabilizer in a chemical conversion coating film was calculated, as the amount of an organic carbon (i.e. expressed in terms of carbon) in the chemical conversion coating film, from the measurement results of a TOC device "TOC-VCS" (manufactured by Shimadzu Corporation).

TABLE 1

| | | | Example | | | | |
|---|---|---|---|---|---|---|---|
| | | | 1 | 2 | 3 | 4 | 5 |
| Chemical conversion agent | Zr | Concentration: ppm | 5 | 50 | 10 | 100 | 100 |
| | Ti | Concentration: ppm | 5 | 10 | 1000 | 50 | 50 |
| | V | Concentration: ppm | 10 | 800 | 100 | 100 | 100 |
| Metal stabilizer | Baypure CX-100 | Concentration: ppm | 100 | — | — | — | — |
| | Iminodiacetic acid | Concentration: ppm | — | 100 | — | — | — |
| | Oxalic acid | Concentration: ppm | — | — | 100 | — | — |
| | Pyrogallol | Concentration: ppm | — | — | — | 100 | — |
| | PL-6757 | Concentration: ppm | — | — | — | — | 100 |
| | Pancil FG-70 | Concentration: ppm | — | — | — | — | — |
| | Techno Color Red ADK | Concentration: ppm | — | — | — | — | — |
| | Ascorbic acid | Concentration: ppm | — | — | — | — | — |
| | pH | | 3.5 | 3.5 | 3.5 | 3.5 | 3.5 |
| Amount of chemical conversion coating film | Zr | $mg/m^2$ | 3 | 12 | 7 | 10 | 8 |
| | Ti | $mg/m^2$ | 8 | 8 | 150 | 24 | 25 |
| | V | $mg/m^2$ | 8 | 69 | 17 | 22 | 22 |
| | C (Metal stabilizer) | $mg/m^2$ | 3 | 4 | 2 | 3 | 2 |
| Evaluation results | Corrosion resistance (500 h) | | 8.0 | 8.5 | 8.5 | 9.0 | 9.0 |
| | Moisture resistance (70° C. 98% RH 500 h) | | 7.5 | 8.0 | 8.5 | 9.0 | 9.0 |

| | | | Example | | | | |
|---|---|---|---|---|---|---|---|
| | | | 6 | 7 | 8 | 9 | 10 |
| Chemical conversion agent | Zr | Concentration: ppm | 100 | 1000 | 2000 | 500 | 500 |
| | Ti | Concentration: ppm | 50 | 10 | 500 | 50 | 50 |
| | V | Concentration: ppm | 100 | 300 | 500 | 100 | 100 |
| Metal stabilizer | Baypure CX-100 | Concentration: ppm | — | — | — | — | — |
| | Iminodiacetic acid | Concentration: ppm | — | — | — | — | — |
| | Oxalic acid | Concentration: ppm | — | — | — | — | — |
| | Pyrogallol | Concentration: ppm | — | — | — | — | — |
| | PL-6757 | Concentration: ppm | — | — | — | — | — |
| | Pancil FG-70 | Concentration: ppm | 100 | — | — | — | — |
| | Techno Color Red ADK | Concentration: ppm | — | 100 | — | — | — |
| | Ascorbic acid | Concentration: ppm | — | — | 100 | 500 | 500 |
| | pH | | 3.5 | 3.5 | 3.5 | 3 | 3.5 |
| Amount of chemical conversion coating film | Zr | $mg/m^2$ | 9 | 65 | 84 | 26 | 23 |
| | Ti | $mg/m^2$ | 24 | 10 | 95 | 20 | 16 |
| | V | $mg/m^2$ | 21 | 35 | 48 | 17 | 14 |
| | C (Metal stabilizer) | $mg/m^2$ | 2 | 2 | 3 | 12 | 10 |
| Evaluation results | Corrosion resistance (500 h) | | 8.5 | 9.5 | 9.5 | 9.5 | 9.5 |
| | Moisture resistance (70° C. 98% RH 500 h) | | 8.0 | 9.5 | 9.5 | 8.5 | 9.5 |

| | | | Example | | | | |
|---|---|---|---|---|---|---|---|
| | | | 11 | 12 | 13 | 14 | 15 |
| Chemical conversion agent | Zr | Concentration: ppm | 500 | 500 | 500 | 500 | 500 |
| | Ti | Concentration: ppm | 50 | 50 | 50 | 50 | 50 |
| | V | Concentration: ppm | 100 | 100 | 100 | 100 | 100 |
| Metal stabilizer | Baypure CX-100 | Concentration: ppm | — | — | — | — | — |
| | Iminodiacetic acid | Concentration: ppm | — | — | — | — | — |
| | Oxalic acid | Concentration: ppm | — | — | — | — | — |
| | Pyrogallol | Concentration: ppm | — | — | — | — | — |
| | PL-6757 | Concentration: ppm | — | — | — | — | — |
| | Pancil FG-70 | Concentration: ppm | — | — | — | — | — |
| | Techno Color Red ADK | Concentration: ppm | — | — | — | 10 | 500 |
| | Ascorbic acid | Concentration: ppm | 500 | 2000 | 10 | — | — |
| | pH | | 5 | 3.5 | 3.5 | 3.5 | 3.5 |
| Amount of chemical conversion coating film | Zr | $mg/m^2$ | 21 | 14 | 32 | 34 | 22 |
| | Ti | $mg/m^2$ | 14 | 8 | 27 | 27 | 15 |
| | V | $mg/m^2$ | 11 | 6 | 25 | 25 | 14 |
| | C (Metal stabilizer) | $mg/m^2$ | 8 | 26 | 1 | 1 | 9 |
| Evaluation results | Corrosion resistance (500 h) | | 8.5 | 8.5 | 9.5 | 9.0 | 9.0 |
| | Moisture resistance (70° C. 98% RH 500 h) | | 9.0 | 9.5 | 8.5 | 9.0 | 9.0 |

TABLE 1-continued

| | | | Comparative Example | | | | |
|---|---|---|---|---|---|---|---|
| | | | 1 | 2 | 3 | 4 | 5 |
| Chemical conversion agent | Zr | Concentration: ppm | 500 | 500 | 500 | — | 500 |
| | Ti | Concentration: ppm | 50 | 50 | — | 50 | 50 |
| | V | Concentration: ppm | 100 | — | 100 | 100 | 100 |
| Metal stabilizer | Ascorbic acid | Concentration: ppm | — | 500 | 500 | 500 | 500 |
| | pH | | 3.5 | 3.5 | 3.5 | 3.5 | 1.5 |
| Amount of chemical conversion coating film | Zr | $mg/m^2$ | 35 | 28 | 27 | — | 7 |
| | Ti | $mg/m^2$ | 28 | 15 | — | 14 | 9 |
| | V | $mg/m^2$ | 26 | — | 13 | 12 | 5 |
| | C (Metal stabilizer) | $mg/m^2$ | — | 12 | 11 | 13 | 5 |
| Evaluation results | Corrosion resistance (500 h) | | 9.0 | 5.0 | 6.0 | 6.0 | 4.0 |
| | Moisture resistance (70° C. 98% RH 500 h) | | 6.0 | 3.0 | 4.0 | 3.5 | 3.0 |

TABLE 2

| | | | | Example | | | | | | | |
|---|---|---|---|---|---|---|---|---|---|---|---|
| | | | | 16 | 17 | 18 | 19 | 20 | 21 | 22 | 23 |
| Chemical conversion agent | | Zr | Concentration: ppm | 5 | 50 | 10 | 100 | 100 | 100 | 1000 | 2000 |
| | | Ti | Concentration: ppm | 5 | 10 | 1000 | 50 | 50 | 50 | 10 | 500 |
| | | V | Concentration: ppm | 10 | 800 | 100 | 100 | 100 | 100 | 300 | 500 |
| | Metal stabilizer | Baypure CX-100 | Concentration: ppm | 100 | — | — | — | — | — | — | — |
| | | Iminodiacetic acid | Concentration: ppm | — | 100 | — | — | — | — | — | — |
| | | Oxalic acid | Concentration: ppm | — | — | 100 | — | — | — | — | — |
| | | Pyrogallol | Concentration: ppm | — | — | — | 100 | — | — | — | — |
| | | PL-6757 | Concentration: ppm | — | — | — | — | 100 | — | — | — |
| | | Pancil FG-70 | Concentration: ppm | — | — | — | — | — | 100 | — | — |
| | | Techno Color Red ADK | Concentration: ppm | — | — | — | — | — | — | 100 | — |
| | | Ascorbic acid | Concentration: ppm | — | — | — | — | — | — | — | 100 |
| | | pH | | 3.5 | 3.5 | 3.5 | 3.5 | 3.5 | 3.5 | 3.5 | 3.5 |
| Adhesion treating agent | | EPOCROS WS-700 | Solid component ratio | 1 | 1 | 1 | 1 | 1 | 1 | 1 | 1 |
| | | PAA-15C | | 1 | 1 | 1 | 1 | 1 | 1 | 1 | 1 |
| | | Laminate film | | PP | PP | PP | PP | PP | PP | PP | PP |
| Amount of chemical conversion coating film | | Zr | $mg/m^2$ | 4 | 12 | 8 | 9 | 10 | 10 | 66 | 89 |
| | | Ti | $mg/m^2$ | 8 | 8 | 155 | 22 | 25 | 24 | 11 | 97 |
| | | V | $mg/m^2$ | 8 | 71 | 17 | 21 | 23 | 22 | 36 | 51 |
| | | C (Metal stabilizer) | $mg/m^2$ | 4 | 3 | 4 | 2 | 4 | 4 | 5 | 4 |
| Evaluation results | | Corrosion resistance (500 h) | | 8.0 | 8.5 | 8.5 | 9.0 | 9.0 | 8.5 | 9.5 | 9.5 |
| | | Moisture resistance ) (70° C. 98% RH 500 h | | 7.5 | 8.0 | 8.5 | 9.0 | 9.0 | 8.0 | 9.5 | 9.5 |
| | | Laminate adhesion | | ○ | ○ | ○ | ○ | ○ | ○ | ○ | ○ |
| | | Hydrofluoric acid resistance | | ○ | ○ | ○ | ○ | ○ | ○ | ○ | ○ |
| | | Alkali resistance | | ○ | ○ | ○ | ○ | ○ | ○ | ○ | ○ |

| | | | | Example | | | | | | | |
|---|---|---|---|---|---|---|---|---|---|---|---|
| | | | | 24 | 25 | 26 | 27 | 28 | 29 | 30 | 31 |
| Chemical conversion agent | | Zr | Concentration: ppm | 500 | 500 | 500 | 500 | 500 | 500 | 500 | 500 |
| | | Ti | Concentration: ppm | 50 | 50 | 50 | 50 | 50 | 50 | 50 | 50 |
| | | V | Concentration: ppm | 100 | 100 | 100 | 100 | 100 | 100 | 100 | 100 |
| | Metal stabilizer | Baypure CX-100 | Concentration: ppm | — | — | — | — | — | — | — | — |
| | | Iminodiacetic acid | Concentration: ppm | — | — | — | — | — | — | — | — |
| | | Oxalic acid | Concentration: ppm | — | — | — | — | — | — | — | — |
| | | Pyrogallol | Concentration: ppm | — | — | — | — | — | — | — | — |
| | | PL-6757 | Concentration: ppm | — | — | — | — | — | — | — | — |
| | | Pancil FG-70 | Concentration: ppm | — | — | — | — | — | — | — | — |
| | | Techno Color Red ADK | Concentration: ppm | — | — | — | — | — | — | 10 | 500 |
| | | Ascorbic acid | Concentration: ppm | 500 | 500 | 500 | 500 | 2000 | 10 | — | — |
| | | pH | | 3 | 3.5 | 3.5 | 5 | 3.5 | 3.5 | 3.5 | 3.5 |
| Adhesion treating agent | | EPOCROS WS-700 | Solid component ratio | 1 | 1 | 1 | 1 | 1 | 1 | 1 | 1 |
| | | PAA-15C | | 1 | 1 | 1 | 1 | 1 | 1 | 1 | 1 |
| | | Laminate film | | PP | PP | PET | PP | PP | PP | PP | PP |
| Amount of chemical conversion coating film | | Zr | $mg/m^2$ | 27 | 24 | 24 | 22 | 15 | 33 | 35 | 24 |
| | | Ti | $mg/m^2$ | 21 | 17 | 17 | 14 | 9 | 27 | 28 | 16 |
| | | V | $mg/m^2$ | 18 | 14 | 14 | 12 | 7 | 26 | 27 | 15 |
| | | C (Metal stabilizer) | $mg/m^2$ | 15 | 12 | 12 | 9 | 31 | 1 | 1 | 9 |
| Evaluation results | | Corrosion resistance (500 h) | | 9.5 | 9.5 | 9.5 | 8.5 | 8.5 | 9.5 | 9.0 | 9.0 |
| | | Moisture resistance (70° C. 98% RH 500 h) | | 8.5 | 9.5 | 9.5 | 9.0 | 9.5 | 8.5 | 9.0 | 9.0 |

TABLE 2-continued

| | | | | | | | | | |
|---|---|---|---|---|---|---|---|---|---|
| | Laminate adhesion | | ○ | ○ | ○ | ○ | ○ | ○ | ○ | ○ |
| | Hydrofluoric acid resistance | | ○ | ○ | ○ | ○ | ○ | ○ | ○ | ○ |
| | Alkali resistance | | ○ | ○ | ○ | ○ | ○ | ○ | ○ | ○ |

| | | | Comparative Example | | | | |
|---|---|---|---|---|---|---|---|
| | | | 6 | 7 | 8 | 9 | 10 |
| Chemical conversion agent | Zr | Concentration: ppm | 500 | 500 | 500 | — | 500 |
| | Ti | Concentration: ppm | 50 | 50 | — | 50 | 50 |
| | V | Concentration: ppm | 100 | — | 100 | 100 | 100 |
| Metal stabilizer | Ascorbic acid | Concentration: ppm | — | 500 | 500 | 500 | 500 |
| | pH | | 3.5 | 3.5 | 3.5 | 3.5 | 1.5 |
| Adhesion treating agent | EPOCROS WS-700 | Solid component ratio | 1 | 1 | 1 | 1 | 1 |
| | PAA-15C | | 1 | 1 | 1 | 1 | 1 |
| | Laminate film | | PP | PP | PP | PP | PP |
| Amount of chemical conversion coating film | Zr | $mg/m^2$ | 36 | 29 | 27 | — | 7 |
| | Ti | $mg/m^2$ | 29 | 15 | — | 15 | 8 |
| | V | $mg/m^2$ | 27 | — | 14 | 13 | 5 |
| | C (Metal stabilizer) | $mg/m^2$ | — | 13 | 14 | 14 | 4 |
| Evaluation results | Corrosion resistance (500 h) | | 9.0 | 5.0 | 6.0 | 6.0 | 4.0 |
| | Moisture resistance (70° C. 98% RH 500 h) | | 6.0 | 3.0 | 4.0 | 3.5 | 3.0 |
| | Laminate adhesion | | x | x | x | x | x |
| | Hydrofluoric acid resistance | | x | x | x | x | x |
| | Alkali resistance | | x | x | x | x | x |

In the chemical conversion agent in Table 1 and Table 2, the Zr concentration represents the zirconium content (concentration expressed in terms of metal element of various ions) in the chemical conversion agent; Ti concentration represents the titanium content (concentration expressed in terms of metal element of various ions) in the chemical conversion agent; and the V concentration represents the vanadium content (concentration expressed in terms of metal element of various ions) in the chemical conversion agent.

As is apparent from the results shown in Table 1, all Examples 1-13 are excellent in corrosion resistance and moisture resistance as compared with Comparative Examples 2-5, and are also excellent in moisture resistance as compared with Comparative Example 1. As is apparent from the results shown in Table 2, all Examples 14-27 are excellent in laminate adhesion, fluorinated acid resistance, and alkali resistance as compared with Comparative Examples 6-10.

These results revealed that the chemical conversion agent of the present invention including (1) zirconium, the content being 5-5,000 ppm by mass; (2) titanium, the content being 5-5,000 ppm by mass; (3) vanadium, the content being 10-1,000 ppm by mass; and (4) a metal stabilizer, the content being 5-5,000 ppm by mass; (5) the pH being 2-6, is capable of providing an aluminum-based metal material with excellent corrosion resistance and moisture resistance, while also providing the aluminum-based metal material with excellent adhesion with a laminate film, excellent hydrofluoric acid resistance, and excellent alkali resistance.

INDUSTRIAL APPLICABILITY

The chemical conversion agent of the present invention is preferably used for a surface treatment of an aluminum member for secondary battery since the chemical conversion agent is capable of providing, for example, an aluminum-based metal material with excellent corrosion resistance and moisture resistance, while also providing the aluminum-based metal material with excellent adhesion with a laminate film, excellent hydrofluoric acid resistance and excellent alkali resistance.

The invention claimed is:

1. A chemical conversion agent, wherein (1) a mass concentration of zirconium is 5-3,000 ppm by mass;

(2) a mass concentration of titanium is 5-500 ppm by mass;

(3) a mass concentration of vanadium is 10-500 ppm by mass;

(4) a total mass concentration of a metal stabilizer selected from the group consisting of oxalic acid, pyrogallol, anthocyanin and ascorbic acid, and an iminodiacetic acid derivative is 10-2,000 ppm by mass; and (5) a pH is 2-6.

2. The chemical conversion agent according to claim 1, wherein said chemical conversion agent is used for a surface treatment of an aluminum-based metal material.

3. A chemical conversion coating film formed using the chemical conversion agent according to claim 1, wherein the amount of zirconium is 3-300 $mg/m^2$; the amount of titanium is 5-300 $mg/m^2$; the amount of vanadium is 1-150 $mg/m^2$; and the amount of the metal stabilizer is 0.5-200 $mg/m^2$ expressed in terms of carbon.

4. A chemical conversion coating film formed using the chemical conversion agent according to claim 2, wherein the amount of zirconium is 3-300 $mg/m^2$; the amount of titanium is 5-300 $mg/m^2$; the amount of vanadium is 1-150 $mg/m^2$, and the amount of the metal stabilizer is 0.5-200 $mg/m^2$ expressed in terms of carbon.

* * * * *